US005588532A

United States Patent [19]

Pharo

[11] Patent Number: 5,588,532

[45] Date of Patent: Dec. 31, 1996

[54] SELF-SEALING INFLATABLE BAG AND METHOD FOR PACKAGING AN ARTICLE THEREIN

[75] Inventor: Daniel A. Pharo, Valencia, Calif.

[73] Assignee: Air Packaging Technologies, Inc., Del.

[21] Appl. No.: 306,883

[22] Filed: Sep. 15, 1994

[51] Int. Cl.[6] ..... B65D 81/02

[52] U.S. Cl. ..... 206/522; 53/472; 53/449

[58] Field of Search ..... 206/522, 591, 206/592; 53/472, 449; 383/3

[56] References Cited

U.S. PATENT DOCUMENTS

| | | | |
|---|---|---|---|
| 3,523,563 | 11/1970 | Mirando . | |
| 4,465,188 | 8/1984 | Soroka et al. | 206/522 |
| 4,551,379 | 11/1985 | Kerr | 206/522 |
| 4,597,244 | 7/1986 | Pharo | 53/434 |
| 4,793,123 | 12/1988 | Pharo | 53/449 |
| 4,872,558 | 10/1989 | Pharo | 206/592 |
| 4,874,093 | 10/1989 | Pharo | 206/522 |
| 4,918,904 | 4/1990 | Pharo | 53/472 |
| 4,949,530 | 8/1990 | Pharo | 53/449 |
| 5,149,065 | 9/1992 | Willden et al. | 206/523 |
| 5,263,587 | 11/1993 | Elkin et al. | 383/3 |
| 5,272,856 | 12/1993 | Pharo | 53/512 |

FOREIGN PATENT DOCUMENTS 128326 2/1990 China .

*Primary Examiner*—David T. Fidei
*Attorney, Agent, or Firm*—Donald S. Dowden

[57] ABSTRACT

An inflatable package is adapted to be formed into a packaging system for retaining an item formed with a pair of inner panels defining an item-receiving zone. Each of a pair of outer panels overlies a respective one of the inner panels to form an inflatable chamber. Overlying edge portions of each respective pair of inner and outer panels are secured together along all overlying edge portions, and overlying edge portions of the inner panels are secured together along at least two substantially parallel edge portions so that the inner panels remain unattached to each other along at least one section to allow insertion of the item into the item-receiving zone. The inflatable chambers are at least partially inflated with a filler medium through an inflating valve. The inflatable chambers are divided into a plurality of sections by bonding each respective pair of inner and outer panels along an interior portion, so that the bonding between each respective pair of inner and outer panels is not uniform and complete, the filling medium can pass between adjacent sections, the bonding is not co-extensive with the two substantially parallel edge portions of the inner panels, and there is a portion of each inflatable chamber which is shaped to substantially enclose the item-receiving zone upon inflation. The filling medium communicates between the inflatable chambers via respective co-extensive holes in the inner panels. The inflatable chambers are sealed upon inflation by inflation pressure acting upon the inflating valve.

12 Claims, 6 Drawing Sheets

SELF-SEALING INFLATABLE BAG AND METHOD FOR PACKAGING AN ARTICLE THEREIN

BACKGROUND OF THE INVENTION

1. Field of the Invention

The present invention relates generally to inflatable packages and, more particularly, to inflatable packages in which inflatable chambers are sealed by inflation pressure from the inflatable chambers.

2. Description of the Prior Art

Packaging devices, including inflatable packaging devices, have long been known. Inflatable packaging devices have substantial advantages as compared to other packaging systems. In particular, inflatable packaging devices have relatively low weight, especially when the inflation medium is air or a selected gas, thereby often saving considerable sums in shipping charges. For example, the present applicant has received U.S. Pat. No. 4,597,244 for a method for forming an inflated wrapping, in which a gift or other item is inserted into an open end of an envelope, the envelope is at least partially inflated with an inert gas and the envelope is thereafter completely sealed.

Inflatable packages also are known which involve inflating inflatable chambers to surround and fit snugly around an object to be packaged. The present applicant has invented a number of packaging devices than can be inflated by the user or shipper at the time an article is prepared for shipment. Such inflatable packaging devices are inflated by inserting a straw or similar tube through a sort of check valve and blowing air or another inflation medium between plies forming the packaging device to inflate the packaging device at the time of use. For example, the applicant has received U.S. Pat. No. 4,793,123 for a rolled-up packaging system and method including an inflatable bag in which an article is inserted and which is rolled up to assume a spiral configuration for retaining the article.

The known inflatable packages have the disadvantage of using valves that, when made as inexpensively as possible, tend to leak or are not easily blown up and sealed upon inflation.

It has been appreciated that it is desirable to design an inflatable package which uses reliable seals rather than seals that leak and that are not easily blown up and sealed upon inflation. To this end, several inflatable packages have been proposed.

U.S. Pat. No. 4,872,558 for a bag-in-bag packaging system and U.S. Pat. No. 4,949,530 for a method for forming a bag-in-bag packaging system, both issued to the present applicant, propose a bag-in-bag packaging system in which an inflated outer bag has an article-carrying inner bag suspended therein. The sealing means disclosed is relatively complicated.

U.S. Pat. No. 4,874,093 for a clam-like packaging system and U.S. Pat. No. 4,918,904 for a method for forming a clam-like packaging system, both issued to the present applicant, propose an inflatable packaging system having a clam-like configuration adapted to compress and retain an article therein. Bag portions are compressed against an article in a pocket to retain it therein. The sealing means disclosed is relatively complicated.

U.S. Pat. No. 5,272,856, issued to the present applicant, proposes a packaging device, and a shipping method using the device, that is flexible, inflatable and reusable. Although there are provisions for selectively sealing the device to retain the inflation air and unsealing it to release the inflation air to deflate the packaging device, the sealing means disclosed, a reusable adhesive means, is relatively complicated.

Chinese Patent Publication No. 128326 proposes a cushioning package which is provided with a plurality of chambers in communication with one another. Although the patent relates to a similar inflatable packaging device, it does not disclose the use of a variable seal for the inflatable chambers of the inflatable packaging device.

U.S. Pat. No. 3,523,563 (Mirando) proposes an integrally formed self-sealing valve having additional integral means to render the valve airtight. A tube made of strips is placed within a single inflatable chamber at an opening thereof. The chamber comprises an item such as an inflatable ornament. When the chamber is completely inflated, an inflating rod used to inflate the chamber is withdrawn, and the strips are forced together because the pressure within the chamber is greater than atmospheric pressure, forcing the strips together into sealing engagement. However, Mirando teaches the use of only one inflatable chamber that is not part of an inflatable packaging device.

The above proposed inflatable packages require the provision of special flaps and the like in order to retain a packaged item therein. This adds to the cost of the package and detracts from its convenient use.

SUMMARY OF THE INVENTION

It is an object of the present invention to overcome the deficiencies of the known inflatable packages by providing an inflatable package which when inflated securely retains a packaged item therein without the provision of additional flaps or other package-closing devices.

It is another object of the present invention to provide a highly effective, flexible, inflatable packaging device that is adapted to enclose and protect an article during shipment and the like and that has a novel structure in which inflatable chambers are securely sealed.

These and other objects of the invention are attained in an inflatable package adapted to be formed into a packaging system for retaining an item therein comprising a pair of overlying inner panels defining an item-receiving zone therebetween to have an item retained therein, and a pair of outer panels each overlying a respective one of the inner panels each outer panel being associated with a different one of the inner panels to form an inflatable chamber therebetween. Securing means secure overlying edge portions of each respective pair of inner and outer panels together along all overlying edge portions of each respective pair of inner and outer panels and secure overlying edge portions of the inner panels together along at least two substantially parallel edge portions of the inner panels so that the inner panels remain unattached to each other along at least one section of the overlying edge portions of the inner panels to allow insertion of the item into the item-receiving zone. Inflating means are provided for at least partially inflating the inflatable chambers with a filler medium. The inflatable chambers are divided into a plurality of sections by bonding each respective pair of inner and outer panels along an interior portion of each respective pair of inner and outer panels substantially parallel to the two substantially parallel edge portions of the inner panels, so that the bonding between each respective pair of inner and outer panels is not uniform and complete, the filling medium can pass between adjacent sections, the bonding is not co-extensive with the two substantially parallel edge portions of the inner panels, and there is a portion of each of the inflatable chambers which is shaped to substantially enclose the item-receiving zone upon inflation. The filling medium communicates between the inflatable chambers through the inner panels via respective co-extensive holes in the inner panels which substantially are in contact with each other and which are bonded together around the holes. The inflatable chambers are sealed upon inflation by inflation pressure from the inflatable chambers acting upon the inflating means. The item-receiving zone is automatically sealed upon inflation of the inflatable chambers to retain the item therein.

In one embodiment of the invention, the inflatable chambers are at least substantially filled with the filler medium to at least substantially encapsulate and compress the inflatable chambers against the article to retain the article within the item-receiving zone.

In another embodiment of the invention, one of the inflatable chambers comprises a number of bonded areas connecting the inner and outer panels in a center portion of the inflatable chamber within one or more of the sections, forming the inflatable chamber into a quilted chamber upon inflation.

In accordance with an independent aspect of the invention, there is provided a method for packaging an article that takes full advantage of the packaging device of the invention.

The above and other objects, features and advantages of the present invention will become apparent from the following detailed description of the preferred embodiments when read in conjunction with the accompanying drawings in which like numbers denote similar features.

DETAILED DESCRIPTION OF THE PREFERRED EMBODIMENT

Figure 1:
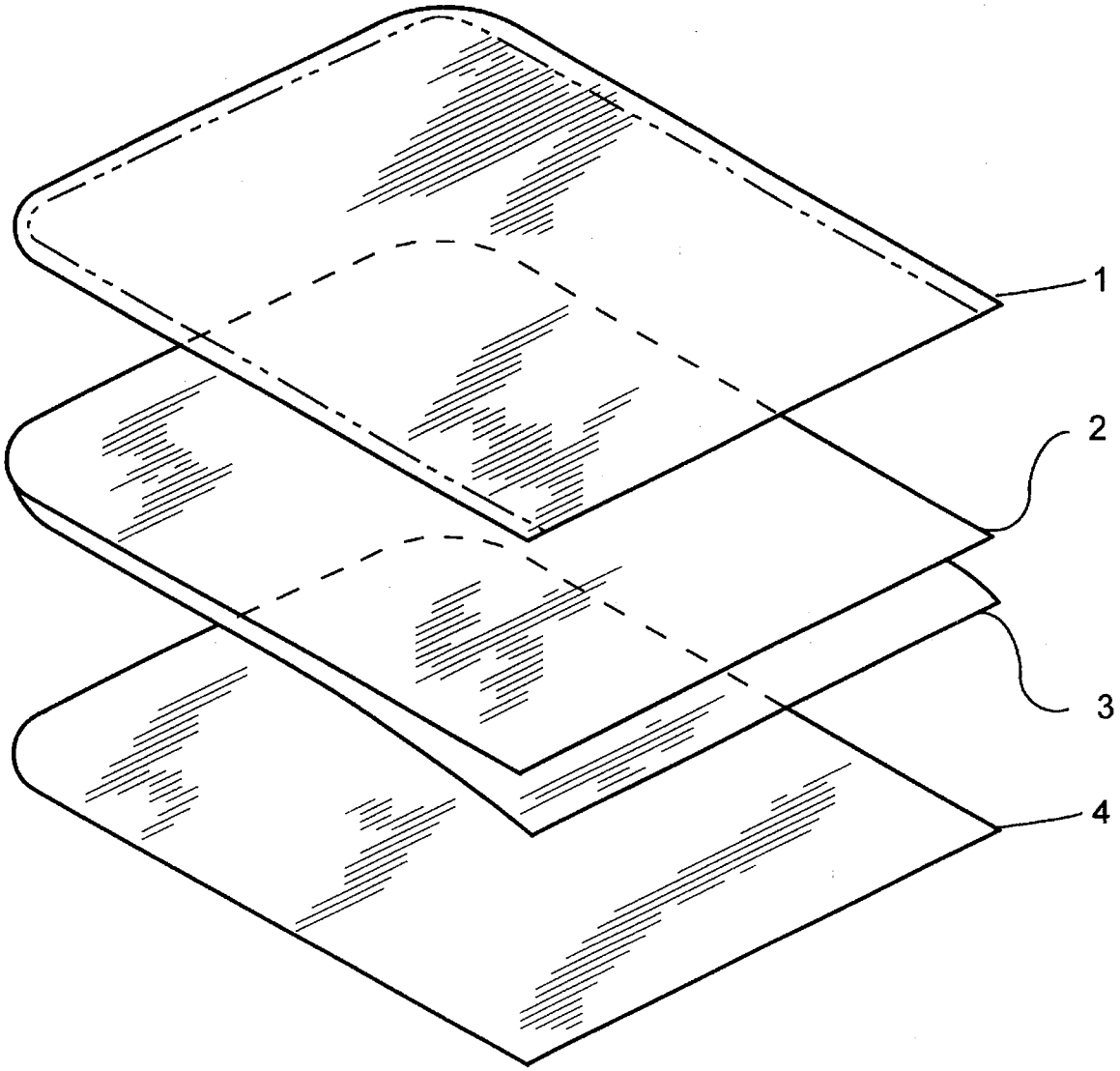
FIG. 1 is an exploded perspective view of the preliminary structure of an inflatable packaging device according to the present invention prior to final assembly.
Figure 2:
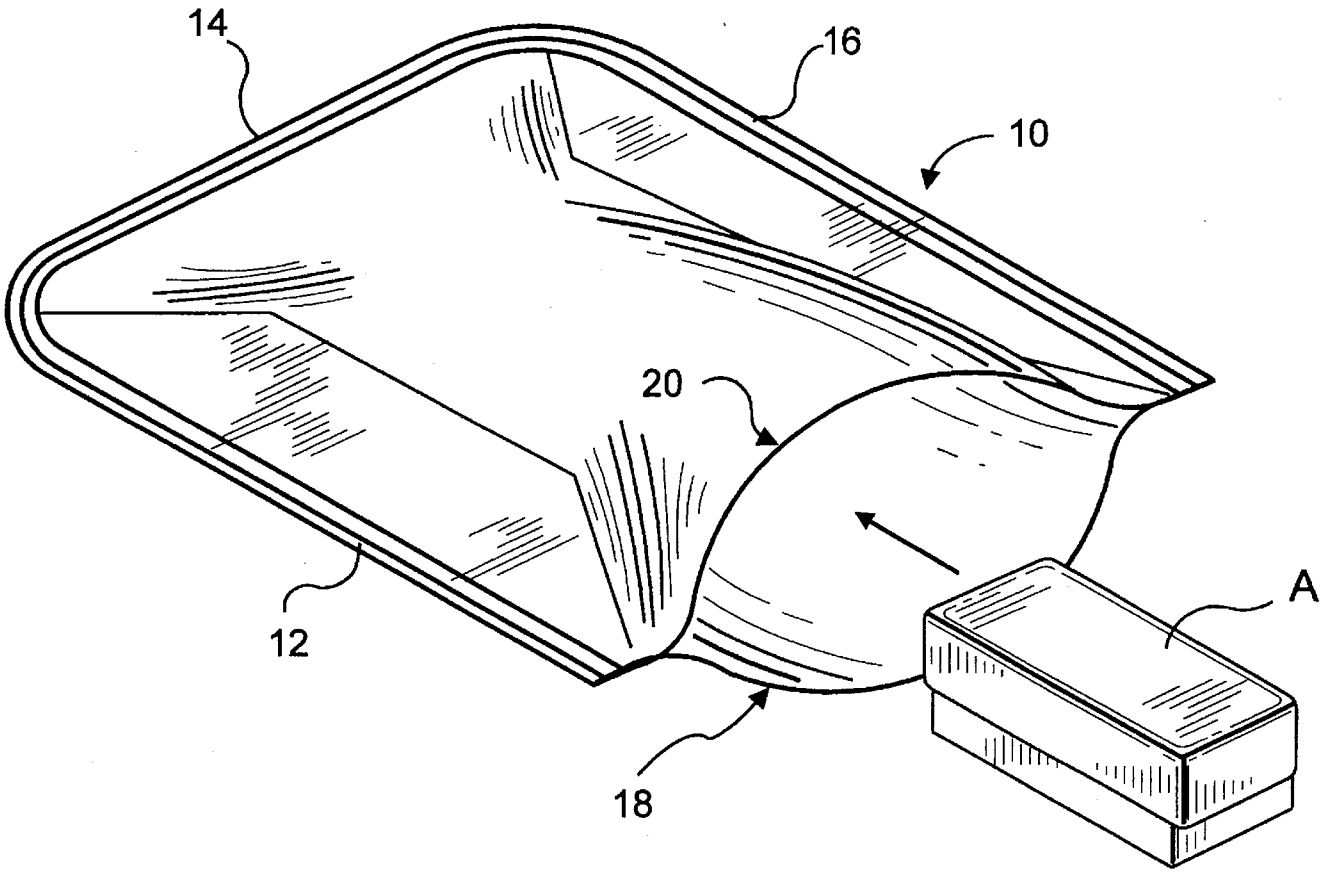
FIG. 2 is a perspective view of an inflatable packaging device according to the present invention showing how an article is inserted therein.

With reference to the drawings, and particularly FIGS. 1 and 2, an inflatable package according to the present invention includes a double walled inflatable packaging system 10 comprising inner panels 2 and 3 defining an item-receiving zone 5 for retaining an article A and a pair of outer panels 1 and 4 defining top and bottom major inflatable chambers (not shown) respectively therein. Article A is compressed between the inflatable chambers to retain it in a fixed position within the inflatable packaging system 10 upon inflation. The inflatable chambers may be expansion chambers where the panels 1–4 are constructed of at least a gas impervious and flexible material as described below. Alternatively, it is within the scope of this invention for the panels 1–4 to be constructed of rigid lightweight material such as a plastic of the type sometimes used in suitcases which is also gas impervious. The panels 1–4 are connected together along corresponding outer segments thereof, preferably by heat sealing techniques as described below, to form the composite package.

The opposite lateral sides of the inflatable packaging system 10 are closed by overlying side edge portions of the panels 1–4 that are sealed together to form side seams 12, 14 and 16, respectively. End edge portions 18 and 20 remain unattached to each other at the frontal side of the packaging system to expose item-receiving zone 5 which is adapted to receive article A therein when the inflatable packaging system 10 is at least partially deflated. Further, inner panels 2 and 3 at the side seam 14 at the end opposite to the opening of the item-receiving zone 5 may remain unattached as well, without impairing the ability of the item-receiving zone 5 to retain the article A upon inflation of the inflatable packaging device 10.

Figure 3:
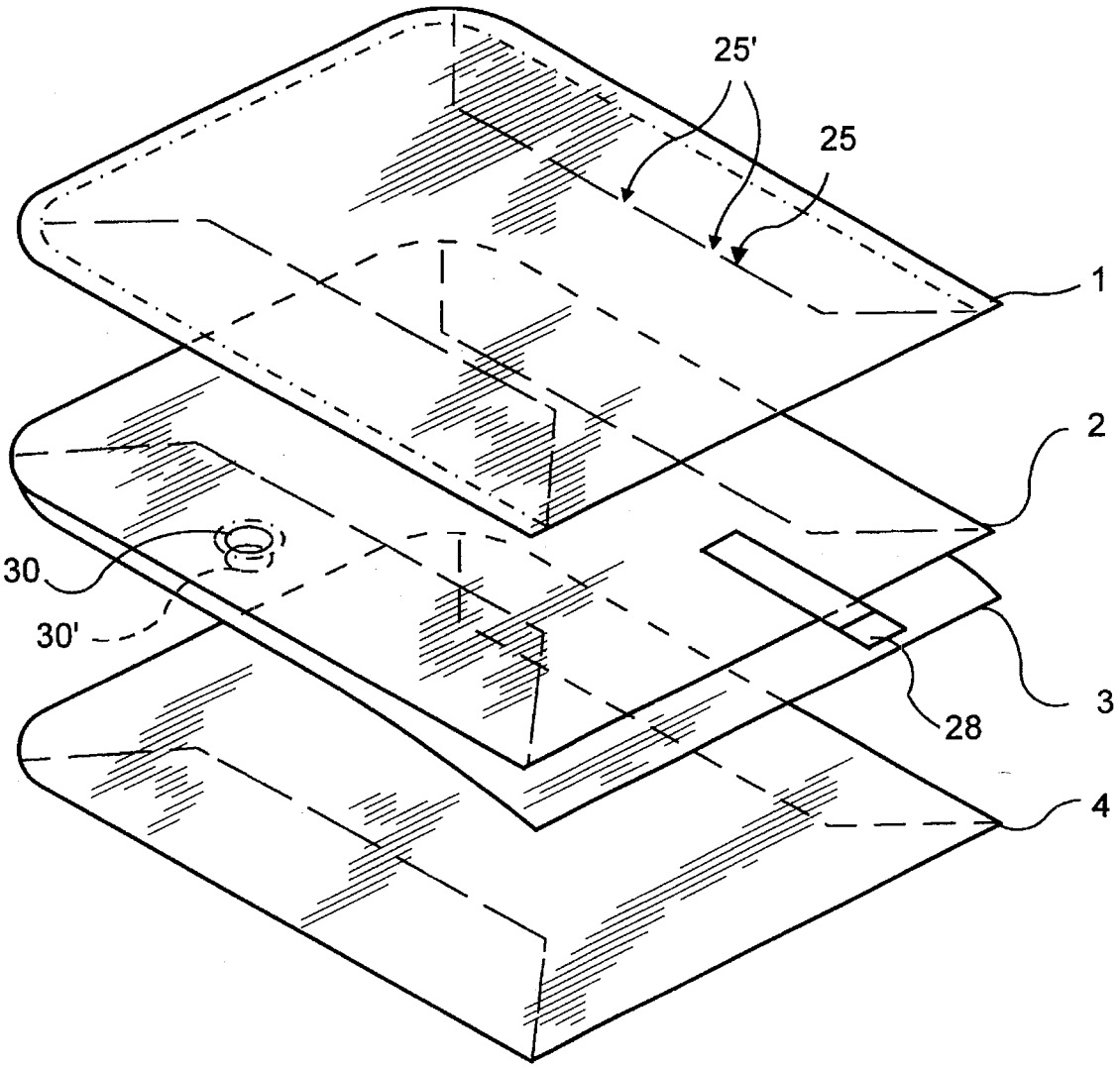
FIG. 3 is an exploded perspective view of a preferred embodiment of an inflatable packaging device showing additional seals according to the present invention.

FIG. 3 illustrates a pre-fabricated package adapted to form the inflatable packaging system 10. The package comprises a pair of superimposed, generally rectangular and co-extensive panels 1–4 heat-sealed together at longitudinally spaced and parallel seams, formed transversely across the panels and between longitudinally spaced ends thereof.

Once the package illustrated in FIG. 1 has been prefabricated to form its open-ended envelope-like configuration as shown in FIG. 2, an article A may be inserted into the item-receiving zone 5 formed between the inner panels 2 and 3. It will be apparent that regardless of the position of the article A within the item-receiving zone 5, it will be firmly held in such position when the packaging system is inflated or otherwise charged or filled with the preselected filler medium, as described hereinafter.

The shape of the item-receiving zone 5 may be varied depending upon the article to be packaged. Thus if the article is box shaped, as is article A shown in FIG. 2, a generally rectangular item-receiving zone between the inner panels 2 and 3 may be used. The article A does not twist, turn or otherwise move or slide around laterally between the inner panels 2 and 3 of the inflatable packaging device 10 during transit.

The sheet material composing the package may comprise a gas-impervious composite laminate, such as the type described in U.S. Pat. No. 4,597,244. For example, each flexible panel 1–4 may be formed from puncture resistant sheets or laminates of polyethylene or of metallized nylon or a similar material often referred to as "Mylar". The panels may also comprise an intermediate layer of aluminum and inner and outer layers of a plastic heat-sealable coating, such as polyethylene, adapted to reactivate (melt) in the range of 300 degrees F. Such composite laminates (which may be constructed to be highly flexible and either inextensible or extensible) may be formed from two thin films bonded together with a known adhesive or brought together using hot fluid polyethylene as the bonding agent. For present purposes, it has been found suitable for the inner and outer panels 1–4 to comprise laminates having a composite thickness in the range of from about one (1) to about ten (10) mils. In the embodiment illustrated in FIG. 2, the panels 1–4 are heat sealed together along the peripheral edges thereof to form the composite inflatable packaging device 10.

Referring again to FIG. 1, exemplary common sealing areas for the four panels 1–4 are located along selected peripheral edge portions of the panels 1–4. The panels 1–4 may be suitably cut and sealed together by conventional apparatus and methods, such as those described in U.S. Pat. No. 4,545,844. It is a particular advantage of the inflatable packaging system 10 of the present invention however that the package itself may be formed from a plurality of continuously running webs of plastic sheeting which are automatically processed into completed packaging such as by superimposing, sealing and cutting at appropriate stages and in an appropriate sequence as desired.

Figure 4:
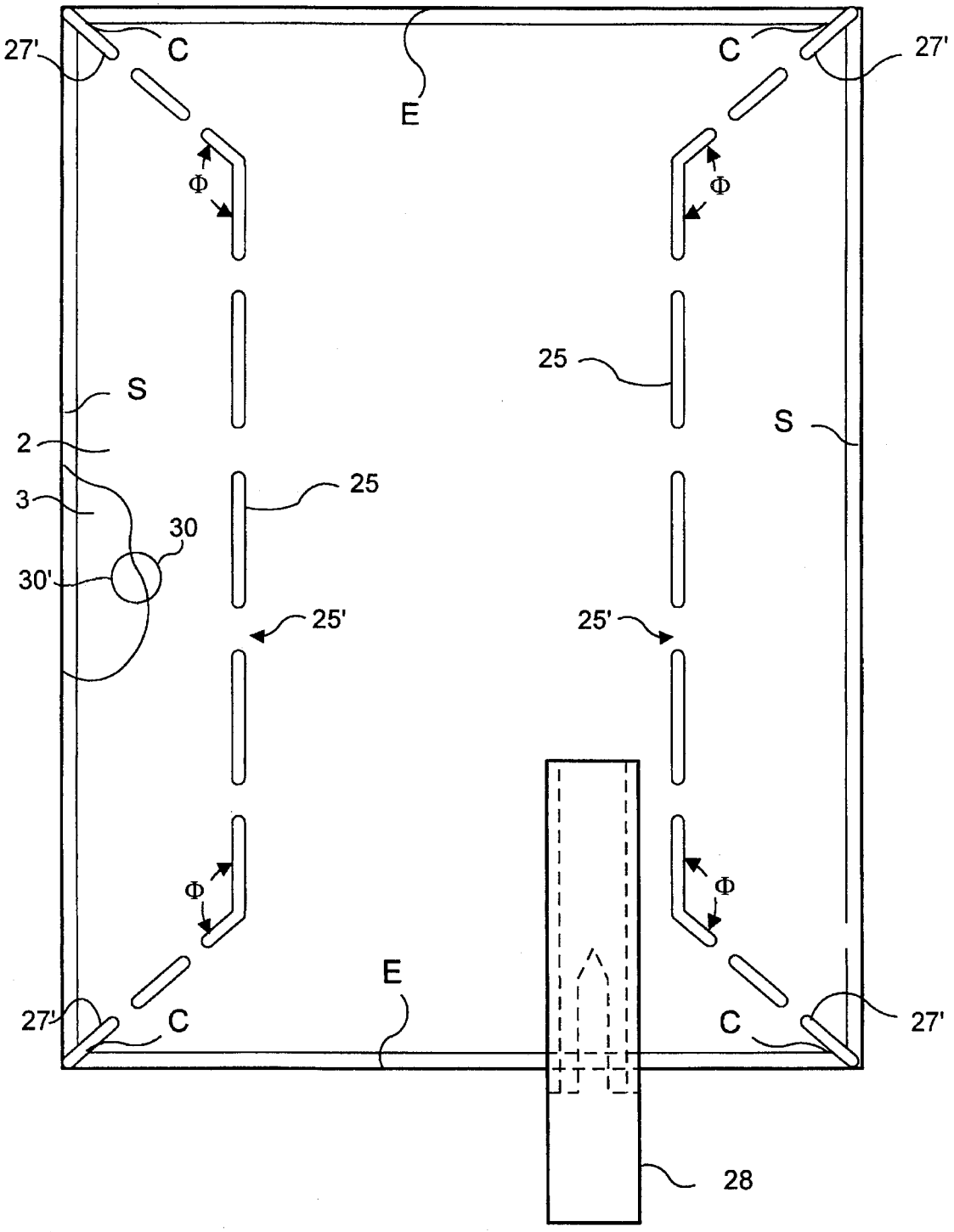
FIG. 4 is a top view of the inflatable packaging device shown in FIG. 3.

FIGS. 3 and 4 illustrate a preferred embodiment of the present invention. In this embodiment, each of the pairs of inner and outer layers 1 and 2 and 3 and 4 are bonded together along bonded lines 25 within the inflatable chambers. The bonded lines as illustrated are substantially parallel to the outer edge portions 12 and 16. Thus, each of the inflatable chambers is divided into a series of three sections as illustrated in FIG. 3. However, the bonded lines 25 are not solid, so that there are spaces or broken bonds 25' through which the filler medium may pass during inflation of the inflatable packaging device 10. Thus, each inflatable chamber will take the shape of three adjacent inflated sections upon inflation. This arrangement provides for the retention of the article A substantially in the central portion of the item-receiving zone 5. Note that the number of sections into which each inflatable chamber may be divided is not necessarily three, but may be two or more.

The bonded lines cannot be parallel co-extensively with the edge portions 12 and 16 so that the end portions of the center section will have a shape which is wider than the other sections at the ends of the sections upon inflation. This arrangement allows for the ends of the center section to expand to block the opening of the item-receiving zone 5 upon inflation, which helps to hold the article A in place upon inflation of the inflatable packaging device 10. Thus, the item-receiving zone 5 would be automatically sealed upon inflation.

An inflating means is incorporated to aid in the inflation of the inflatable chambers and to help seal the inflatable chambers upon inflation. In the preferred embodiment illustrated in FIG. 3, the inflating means comprises a flat valve 28 inserted between layers 1 and 2. The flat valve 28 may be composed of two pieces of the same material used to make the panels 1–4 or other suitable material. The flat valve 28 would thus be formed by bonding the long edges of the material together by heat sealing heat sealing or other bonding method to create a type of tunnel. The flat valve 28 may be glued or otherwise attached in place within the opening between layers 1 and 2 so that the flat valve 28 will not move or shift during inflation.

The inflatable chambers contain holes 30, 30' through the inner panels 2 and 3, respectively. It is through the holes 30, 30' that the filling medium passes between the inflatable chambers. As described more fully hereinafter, a filler medium such as pressurized air is injected into the flat valve 28 and from there passes respectively through holes 30, 30' in the inner panels 2 and 3 within the inflating portion 30 and into the top and bottom chambers respectively on either side of the item-receiving zone 5.

Fluid-flow communication between the two inflatable chambers may be achieved in this preferred embodiment by the use of co-extensive respective holes 30, 30' through the inner layers 2 and 3 near one edge of the inflatable chambers. The holes 30, 30' are co-extensive to the extent that they overlap, allowing the filling medium to pass freely through both inner panels 2 and 3. The inner layers 2 and 3 may be bonded together around the holes 30, 30' so that there will be no shifting upon inflation.

Inflation of the inflatable chambers through the flat valve 28 is accomplished by the insertion of an inflation tube or straw (not shown) through the flat valve so that an open end of the tube or straw is located within the inflatable chamber defined by inner and outer panels 1 and 2 while the other open end of the tube or straw remains outside the inflatable packaging device 10. Inflation is accomplished by forcing the filling medium through the tube or straw, which passes through the tube or straw within the flat valve 28, into the inflatable chamber, through the various sections, and through the holes 30, 30' into the second inflatable chamber and second set of sections.

After the article A has been inserted into item-receiving zone, a standard inflation apparatus can be utilized to charge and pressurize the inflatable chambers to an inflation pressure exceeding ambient pressure, e.g., exceeding an absolute pressure of 14.7 psi at sea level. Alternatively, human lung power can be utilized to inflate the chambers with air. It may also be desirable to cause the inflatable chambers to be filled as a result of a gas producing reaction between pre-measured amounts of selected reactant chemicals, for example baking soda and vinegar. The reactants may be provided within the package structure in the form of capsules (not shown) which may simply be crushed after the package is assembled and filled in order to allow the reactants to mix together and produce the inflating gas. Other types of gases, such as helium or carbon dioxide, can be utilized as a filler medium, as well as foam or a suitable liquid such as water.

Inflation of the chambers causes substantial encapsulation of the article A between the inner panels 2 and 3 as a result of the pressure of the filler medium within the inflatable chambers. The article A is thereby supported and held at a fixed position between the inflated inflatable chambers. Compressive forces occasioned by the pressured fluid are directed inwardly and uniformly against the exposed surfaces of the flexible inner panels 2 and 3 to compress and conform them to the contours of the article A. Retention of the article A in a fixed position within the inflatable packaging device 10 is further aided by the horizontal components of forces acting on inner surface positions of transversely disposed side seams 12 and 14 of the package. The use of sections within the inflatable chambers provides a packaging system which more uniformly distributes the force over the body of the article A by completely surrounding it.

After the inflatable packaging device 10 has been inflated to encapsulate and suspend the article A at its preselected fixed position between the inflation chambers, the inflating tube or straw is removed. A seal is formed by the inflation pressure of the inflated inflatable chambers acting upon the flat valve 28. The inflation pressure of the inflated inflatable chambers presses the internal flaps of the flat valve 28 together so that the flat valve 28 is completely flattened and does not permit any of the filling medium to pass from the inflatable chambers to the outside of the inflatable packaging device 10. Thus a complete seal is formed in a simple manner from the effect of the inflation pressure of the inflated inflatable chambers acting upon the flat valve 28.

Figure 5:
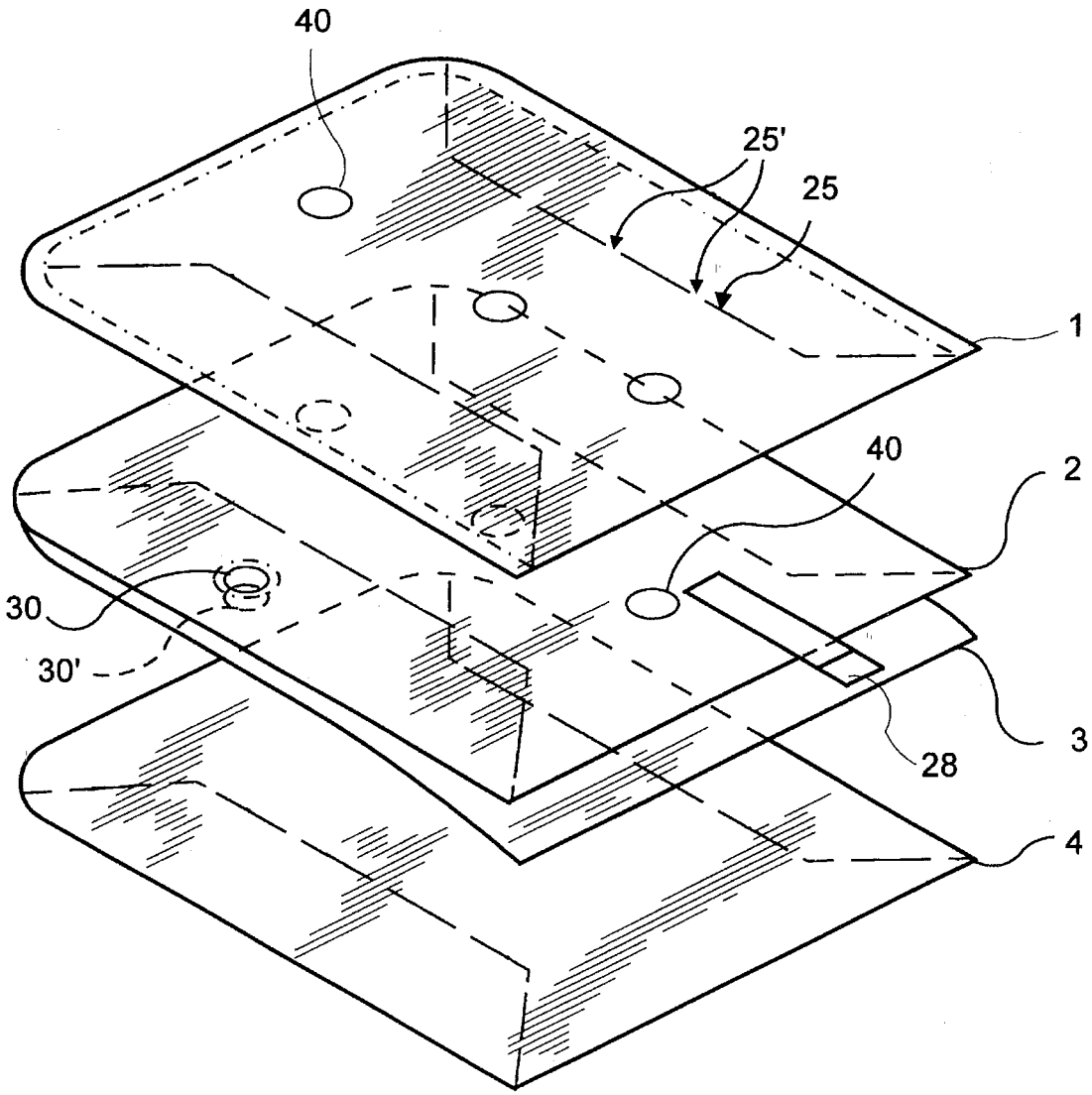
FIG. 5 is an exploded perspective view of another preferred embodiment of an inflatable packaging device according to the present invention.
Figure 6:
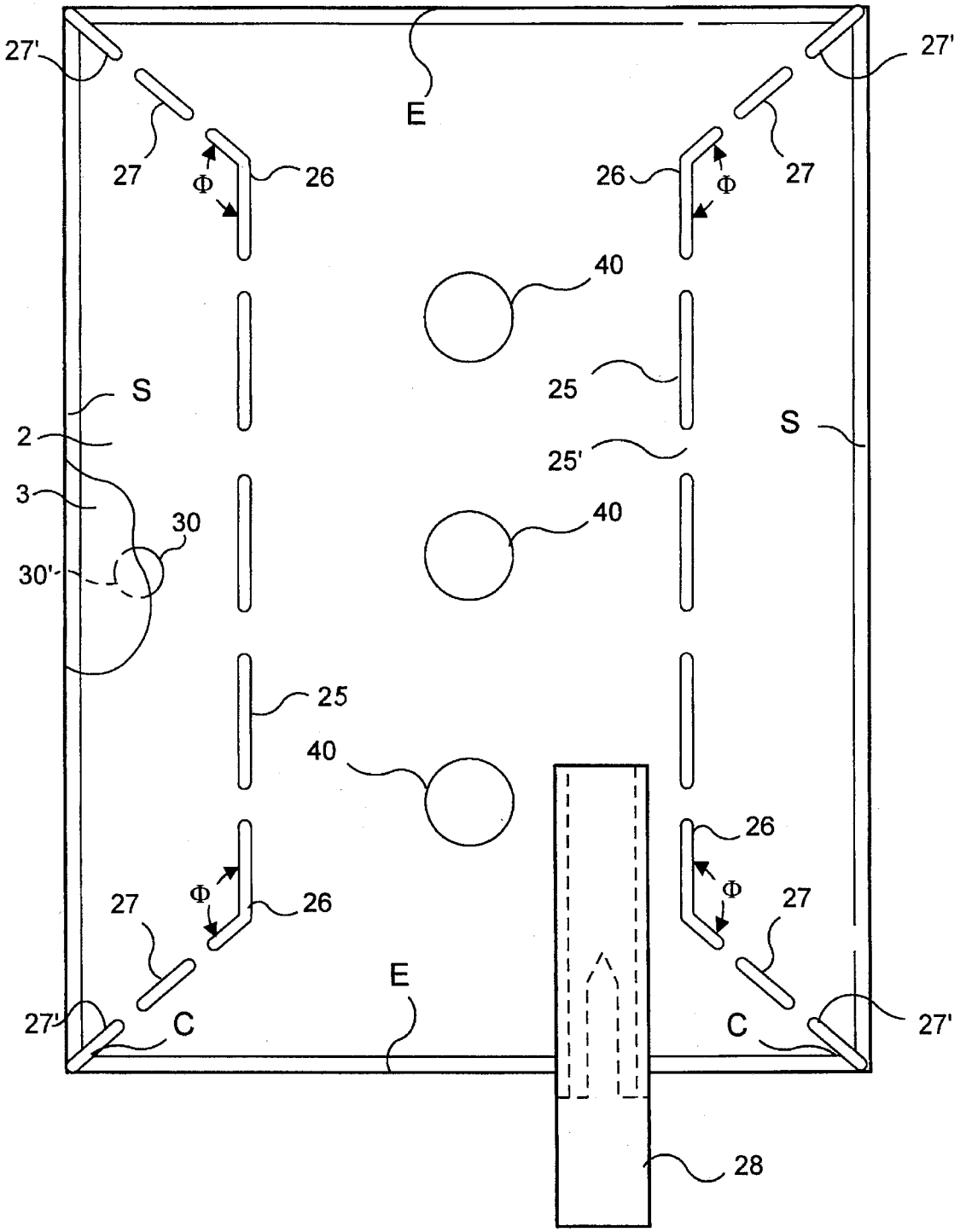
FIG. 6 is a top view of the inflatable packaging device shown in FIG. 5.

FIGS. 5 and 6 show another preferred embodiment of the present invention involving a modified structure in which the respective inner and outer panels 3 and 4 forming one of the inflation chambers such as the bottom inflatable chamber may be fastened together at a plurality of selected locations other than the peripheral edges, but within the sections formed by bonding, so that the overall effect resembles a tufted or quilted exterior surface. The fastening points 40 may be created in any suitable way such as by spot heat sealing or stitching and the like. Heat sealing is preferred for its efficiency in connection with automated manufacturing techniques, but the invention is not limited to the use of heat seals. Another possible method for creating the fastening points 40 involves the use of u.v. curing adhesives. Such an arrangement serves to reduce the overall bulk of the composite inflated package and also improves the aesthetic appearance of the package. Although any suitable pattern or design may be used, as desired, it is preferred that the number and effect of such fastening points 40 be suitably limited to reduce the bulk of the package without otherwise interfering with the inflation of the inflatable chamber.

The construction of the inflatable packaging device is otherwise similar to that illustrated in FIGS. 3 and 4 and described above.

In the embodiments described above, the bonded lines 25 form obtuse angles θ at vertices 26. These angles can be varied within wide limits, for example between an angle substantially less than 90° and an angle substantially larger than 160°. A good choice for θ is a value within the range of 130° to 150°, for example about 140°. In adjusting the angles θ, the portions 28 preferably remain parallel to the sides S of the package and the portions 27 are reoriented. The portions 27 and 28 moreover need not form straight lines, and the vertices 26 need not be sharply defined. The outer ends 27' of the portions 27 preferably terminate at the corners C or sides S of the package rather than at the ends E.

The structures are not limited to an inflatable packaging device having precisely the two inflatable chambers as described herein. Multiple chambers of any appropriate number and size may be formed in any of the preferred embodiments without departing from the scope of the invention.

A major advantage of the present invention is the flexibility provided in constructing the inflatable packaging system to meet different packaging needs. It should be noted that the size and shape of the item-receiving zone may be varied without departing from the scope of the present invention.

Thus there is provided in accordance with the invention a novel and highly effective inflatable packaging device that is adapted to enclose and protect an article during shipping and the like and that accomplishes the objects of the invention as set out above. A method of employing the device to full advantage is also provided. Many variations or modifications of the present invention can be envisioned by one of ordinary skill in the art. Accordingly, the invention is intended to include all structure and methods that fall within the scope of the appended claims.

I claim:

1. A inflatable package adapted to be formed into a packaging system for retaining an item therein comprising:

a pair of overlying inner panels defining an item-receiving zone therebetween to have an item retained therein;

a pair of outer panels each overlying a respective one of said inner panels, each said outer panel being associated with a different one of said inner panels to form an inflatable chamber therebetween;

securing means for securing overlying edge portions of each respective pair of said inner and outer panels together along all overlying edge portions of each respective pair of said inner and outer panels and for securing overlying edge portions of said inner panels together along at least two substantially parallel edge portions of said inner panels so that said inner panels remain unattached to each other along at least one section of the overlying edge portions of said inner panels to allow insertion of said item into said item-receiving zone;

inflating means for at least partially inflating said inflatable chambers with a filler medium;

wherein said inflatable chambers are divided into a plurality of sections by bonding each respective pair of said inner and outer panels along an interior portion of each respective pair of said inner and outer panels, so that the bonding between each respective pair of said inner and outer panels is not uniform and complete, the filling medium can pass between adjacent sections, the bonding is not co-extensive with said two substantially parallel edge portions of said inner panels, and there is a portion of each of said inflatable chambers which is shaped to substantially enclose said item-receiving zone upon inflation;

said filling medium communicates between said inflatable chambers through said inner panels via respective holes in said inner panels, said inner panels being bonded together around said holes;

said inflatable chambers are sealed upon inflation by inflation pressure acting upon said inflating means; and said item-receiving zone is automatically sealed upon inflation of said inflatable chambers to retain said item therein.

2. The inflatable package according to claim 1 wherein said inner and outer panels are generally rectangular and are co-extensive with each other.

3. The inflatable package according to claim 1 wherein each of said inner and outer panels is composed of a gas impervious, flexible material.

4. The inflatable package according to claim 1 wherein said inflatable chambers are at least substantially filled with said filler medium to at least substantially encapsulate and compress said inflatable chambers against said item to retain said item within said item-receiving zone.

5. The inflatable package according to claim 1 wherein said filler medium comprises a pressurized fluid.

6. The inflatable package according to claim 1 wherein said filler medium comprises foam.

7. The inflatable package according to claim 1 wherein said inflating means extends through and is sealed into an opening in the overlying edge portions of one respective pair of said inner and outer panels for communicating said filler medium to said inflatable chambers.

8. The inflatable package according to claim 7 wherein said inflating means comprises a flat valve.

9. The inflatable package according to claim 1 wherein at least one respective pair of said inner and outer panels defining an inflatable chamber further comprises a plurality of bonded areas connecting said respective pair of said inner and outer panels in a center portion of said inflatable chamber within one or more of said sections forming said inflatable chamber into a quilted chamber upon inflation.

10. A method for packaging an item comprising the steps of forming an item-receiving zone from a pair of overlying inner panels;

forming a pair of inflatable chambers from a pair of outer panels each overlying a respective one of said inner panels, each outer panel being associated with a different one of said inner panels;

securing overlying edge portions of each respective pair of said inner and outer panels together along all overlying edge portions of each respective pair of said inner and outer panels;

securing overlying edge portions of said inner panels together along at least two substantially parallel edge portions of said inner panels;

leaving said inner panels unattached to each other along at least one section of the overlying edge portions of said inner panels to allow insertion of said item into said item-receiving zone;

dividing said inflatable chambers into a plurality of sections by bonding each respective pair of said inner and outer panels along an interior portion of each respective pair of said inner and outer panels, so that the bonding between each respective pair of said inner and outer panels is not uniform and complete, the filling medium can pass between adjacent sections, the bonding is not co-extensive with said two substantially parallel edge portions of said inner panels, and there is a portion of each of said inflatable chamber which is shaped to substantially enclose said item-receiving zone upon inflation;

communicating said filling medium between said inflatable chambers through said inner panels via respective holes in said inner panels, said inner panels being bonded together around said holes;

placing an item within said item-receiving zone;

at least partially inflating said inflatable chambers with a filler medium through said inflating means; and sealing said inflatable chambers upon inflation by inflation pressure acting upon said inflating means;

said item-receiving zone being automatically sealed upon inflation of said inflatable chambers to retain said item therein.

11. The method of claim 10 further comprising at least substantially filling said inflatable chambers with said filler medium to at least substantially encapsulate and compress said inflatable chambers against said item to retain said item within said item-receiving zone.

12. The method of claim 10 further comprising forming at least one of said inflatable chambers into a quilted chamber with a plurality of bonded areas connecting said respective pair of said inner and outer panels in a center portion of said inflatable chamber within one or more of said sections.

* * * * *